United States Patent [19]

Breeden et al.

[11] Patent Number: 4,498,370

[45] Date of Patent: Feb. 12, 1985

[54] POWER TRANSMISSION

[75] Inventors: Robert H. Breeden, Metamora; Henry D. Taylor, Pontiac, both of Mich.

[73] Assignee: Vickers, Incorporated, Troy, Mich.

[21] Appl. No.: 351,180

[22] Filed: Feb. 22, 1982

[51] Int. Cl.[3] ..... F15B 11/22

[52] U.S. Cl. ..... 91/171; 91/189 R; 91/453; 91/522; 91/529; 92/137; 212/153; 212/160

[58] Field of Search ..... 91/171, 189 R, 168, 91/522, 523, 178, 182, 367, 453, 461, 529; 212/153, 159, 160, 161, 267, 268; 414/718; 92/137, 146

[56] References Cited

U.S. PATENT DOCUMENTS

| | | | |
|---|---|---|---|
| 2,974,639 | 3/1961 | O'Connor et al. | 91/388 X |
| 3,480,328 | 11/1969 | Carlson | 91/171 |
| 3,633,460 | 1/1972 | Ohniwa | 92/146 |
| 3,752,327 | 8/1973 | Olson | 212/161 |
| 3,757,899 | 9/1973 | Smith, Jr. | 91/171 |
| 3,777,629 | 12/1973 | Johnston et al. | 92/146 |
| 3,817,153 | 6/1974 | Zunzer | 91/529 |
| 3,847,060 | 11/1974 | Jasinski et al. | 91/453 |
| 3,927,603 | 12/1975 | Bernhoft | 91/529 |
| 3,997,062 | 12/1976 | Hassall | 91/171 X |
| 4,112,823 | 9/1978 | Liberman et al. | 91/189 R X |

*Primary Examiner*—Robert E. Garrett
*Assistant Examiner*—Richard S. Meyer
*Attorney, Agent, or Firm*—Barnes, Kisselle, Raisch, Choate, Whittemore & Hulbert

[57] ABSTRACT

A hydraulic system for synchronizing telescoping sections of a crane boom comprising a fixed section and second, third and fourth sections that can be extended and retracted, hydraulic cylinders between the sections for extending and retracting the adjacent sections relative to one another and a control valve for each cylinder. Cables are provided between the sections such that a non-uniformity in movement of the sections causes a change in displacement of the cables which is sensed by position sensing devices to provide a hydraulic pilot signal for modifying flow of hydraulic fluid to the cylinders.

6 Claims, 7 Drawing Figures

POWER TRANSMISSION

This invention relates to crane booms comprising a plurality of telescoping sections which are extended or retracted and particularly to a hydraulic system for synchronizing the movement of the telescoping sections.

BACKGROUND AND SUMMARY OF THE INVENTION

A crane boom typically consists of a plurality of telescoping sections which are extended or retracted to obtain a desired reach. Hydraulic actuators such as cylinders are utilized between adjacent sections and individual hydraulic valves control the flow rate of hydraulic fluid to each cylinder. The crane operator is required to operate a plurality of control valves simultaneously when commanding either extension or retraction of the boom making it difficult to produce equal extension of each section.

Accordingly, among the objectives of the present invention are to provide an automatic system to insure synchronization during the extension and retraction of the sections of the boom.

In accordance with the invention, cables are provided between the sections such that a non-uniformity in movement of the sections causes a change in displacement of the cables which is sensed by position sensing devices to produce a hydraulic pilot signal for modifying flow of hydraulic fluid to the actuators.

DESCRIPTION

Figure 1:
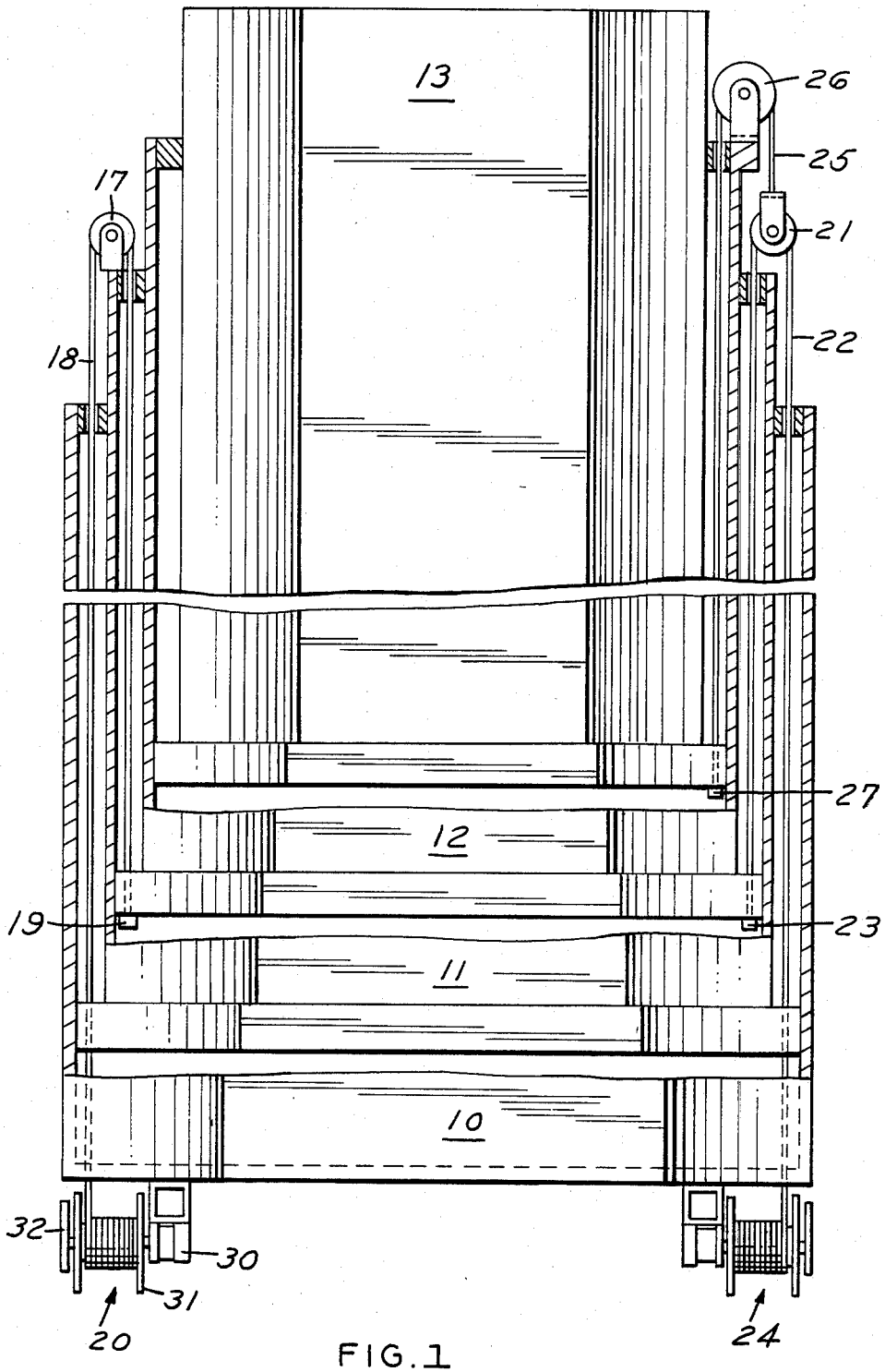
FIG. 1 is a partly diagrammatic view of a typical crane boom embodying the invention.

Referring to FIG. 1, a typical crane boom comprises a fixed section 10 and first, second and third telescoping sections 11, 12 and 13. A first hydraulic cylinder 14 (FIG. 2) is provided between fixed section 10 and first movable section 11; a second hydrualic cylinder 15 is provided between the first and second movable sections 11 and 12; and a third hydraulic cylinder 16 is provided between the second and third movable sections 12 and 13 such that each hydraulic cylinder can be used for extending and retracting the adjacent sections relative to one another. Such booms may, for example, be capable of being extended to several hundred feet.

Figure 2:
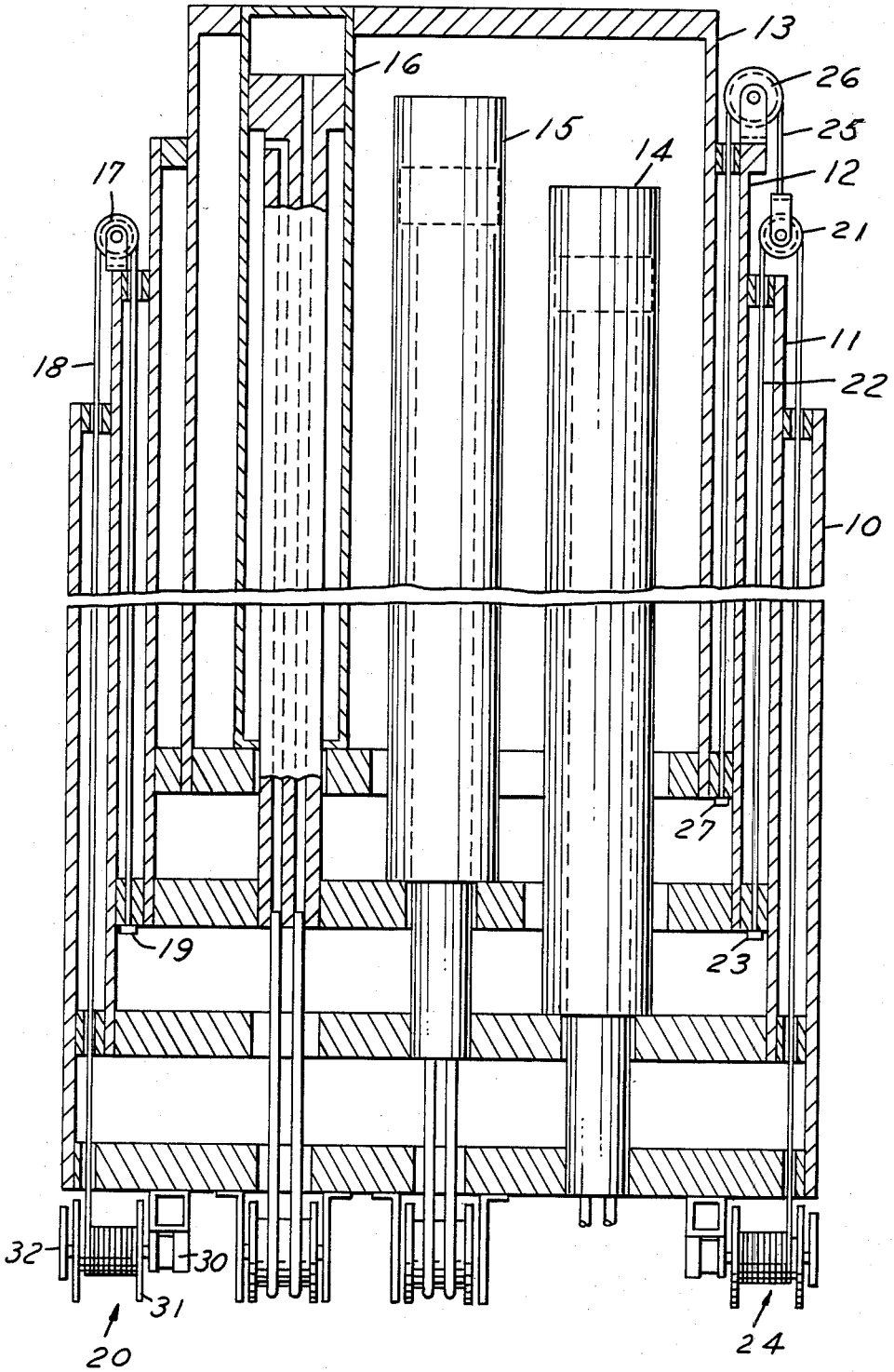
FIG. 2 is a sectional view of the boom shown in FIG. 1.
Figure 3:
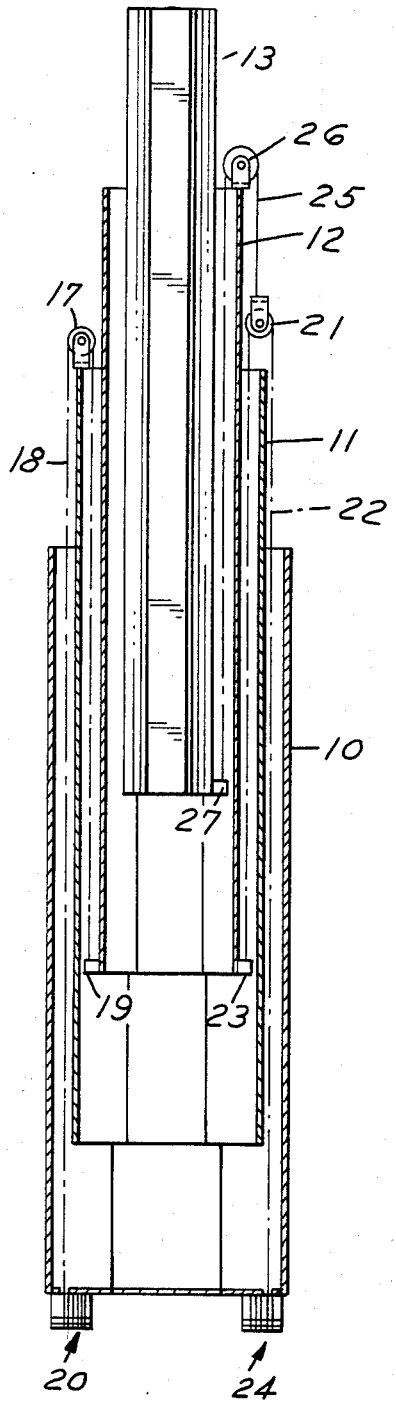
FIG. 3 is a diagram of a portion of the system.

Referring to FIGS. 2 and 3, the system embodying the invention includes a first pulley 17 on the first movable section 11 and a first cable 18 fixed to the third section 12 at 19, trained over the pulley 17 and extending to a position sensing device 20 on the fixed section 10. The system further includes a second pulley 21 and a cable 22 fixed to the third section 12 as at 23 and trained over the second pulley 21 and attached to a second position sensing device 24 associated with the fixed section 10. A third cable 25 is attached to the second pulley 21 and trained over a third pulley 26 fixed to the second movable section 12 and has its other end attached, as at 27, to the third movable section 13.

Thus, the cable system on the left as viewed in FIG. 3 is able to provide a position signal indicating the amount of extension of the section 12 relative to the section 11. If the sections 11, 12 extend or retract uniformly, the tension cable will remain taut and not move with respect to the stationary section 10. If section 12 extends faster relative to section 11 than section 11 extends relative to the fixed section 10, the tension cable will lengthen indicating a position signal. The position sensing device 20 is capable of reeling in the cable so that an error signal is provided that can be used to correct the flow rates to the respective hydraulic cylinders.

The tension cable system on the right side of FIG. 3 will likewise provide an error signal if there is uneven movement of section 13 relative to section 12 compared to one-half of the movement of section 12 relative to section 10.

Figure 4:
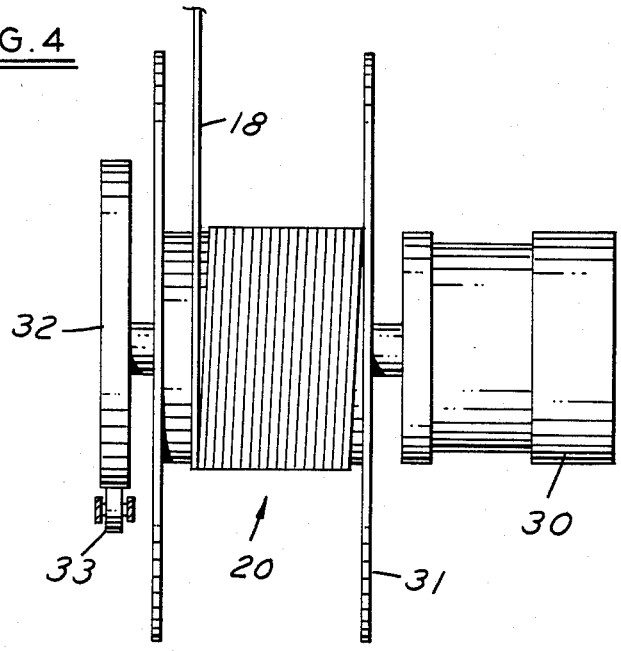
FIG. 4 is a fragmentary view of another portion of the system.

Each position sensing device 20, 24 is identical and, as shown in FIG. 4, comprises a hydraulic motor 30 that produces a continuous torque for driving a drum 31 to which the end of the cable is attached. A cam 32 is attached to the shaft of the drum and the cam follower 33 of a hydraulic remote valve 34 (FIG. 5) engages the cam 32.

Figure 6:
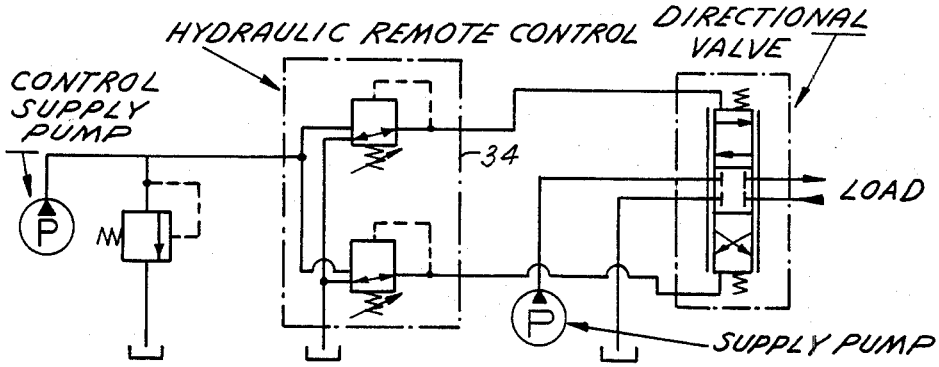
FIG. 6 is a hydraulic schematic of a typical single function hydraulic remote control utilized in the system.

As shown in FIG. 6, a typical pilot operated directional valve is utilized to control fluid flow to the hydraulic cylinders from a supply pump. The pilot pressure from a control supply pump is directed by one or the other of a pair of valves forming the hydraulic remote control valve 34 to actuate the directional valve in one direction or the other.

Figure 7:
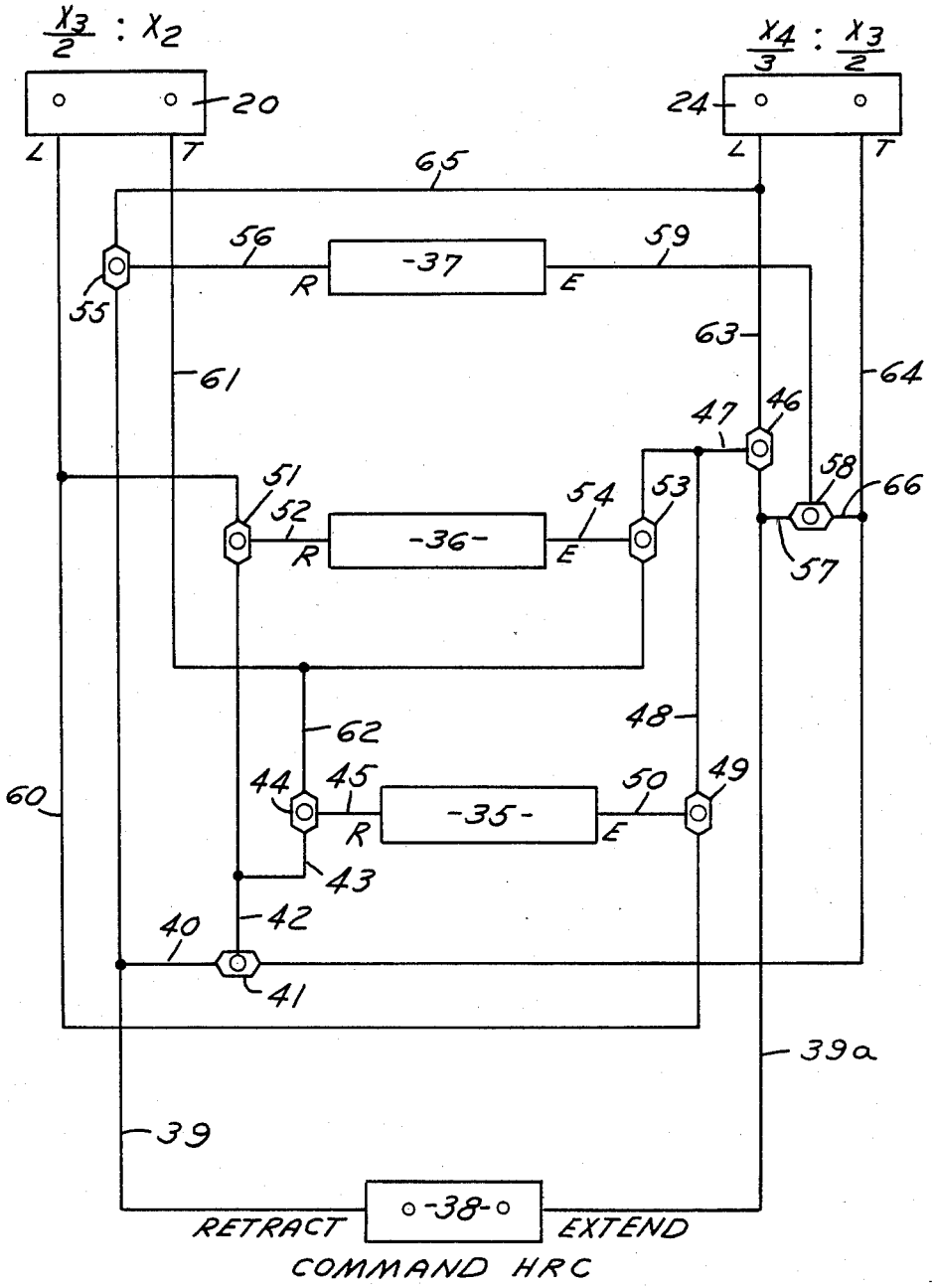
FIG. 7 is a schematic of the control portion of the hydraulic system.

Thus, whenever there is rotation of the cam 32, a pilot pressure signal is provided in the hydraulic remote control valve 34 that can be utilized to oppose the pilot pressure commands normally being applied to the directional valve for controlling the operation of the cylinders 14, 15 and 16. A typical schematic is shown in FIG. 7 wherein a command hydraulic remote control valve or HRC valve 38 is provided for producing RETRACT or EXTEND signals to individual directional valves 35, 36, 37 for controlling the linear hydraulic cylinders 14, 15, 16, respectively. Each of the position sensing valves 34 (FIG. 5) of the position sensing devices 20, 24 is connected such that the pilot pressure signals can be utilized to oppose the pilot pressure commands normally being applied to the directional valves supplying each hydraulic cylinder.

A command to either extend or retract is introduced by manually controlling the HRC valve 38. Pilot pressure is applied equally to the directional valves 35, 36 and 37. As long as the cylinders extend or retract evenly, the cams 32 (FIG. 5) remain in the neutral position, and bias pressures are not introduced by the valves 34 (FIG. 5) of the position sensing devices.

Consider the case when an EXTEND command is introduced. As long as the extension, $X_3$, of section 12 is twice the extension, $X_2$, of section 11; the cable on the left side in FIG. 3 will neither reel in nor reel out from the drum. The cam 32 (FIG. 5) will allow the control valves 34 (FIG. 5) to remain in the neutral position. If section 11 extends too fast, $X_{3/2}$ will be less than $X_2$, and cable will be pulled from the drum and a pilot pressure will be generated from the position sensor 20 by the valve 34, shown in FIG. 5. The cable will tend to be pulled tight, and pressure will build up at the port marked "T". The pressure will be applied to the R or RETRACT side of valve 35, and will reduce the differential pressure shifting the directional valve 35 in the E or EXTEND direction. The flow rate to the cylinder controlling section 11 will slow down, maintaining synchronization between cylinders controlling sections 11 and 12. Similarly, other errors in synchronization will result in correction thereof by application of pilot pressure which tends to slow a cylinder or cylinders which are moving too fast.

It is anticipated that the system will normally be capable of keeping the cylinder synchronized within allowable limits. However, in the event that synchronization is lost, it is considered desirable that sufficient cable be stored on the drum to accommodate extreme errors. Also the drum should have sufficient reel-in capacity to accommodate extreme errors. Depending on the hydraulic system, it is anticipated that, if synchronization is lost, it can be re-established by bottoming the cylinders at extremes of travel.

The command HRC valve 38 and the position sensing valves 34 of the pilot sensing devices 20, 24 comprise conventional single-function valves known as hydraulic remote control or HRC valves such as shown at 34 in the typical circuit of FIG. 6.

Although the system has been described in connection with hydraulic cylinders which have a piston which is extended and retracted, it can also be utilized with other hydraulic actuators such as a rotary hydraulic motor driving a linearly translatable device attached to a boom section such as a lead screw or chain drive. Although the system has been described as using cables, such term is intended to mean any flexible devices which will function in a similar fashion such as a chain.

Specifically, as shown in FIG. 7, hydraulic command pilot signals are provided by the command HRC valve 38 to directional valve 35 through line 39, line 40, shuttle valve 41, line 42, line 43, shuttle valve 44 to line 45 at the R end and through line 39*a*, shuttle valve 46, line 47, line 48, shuttle valve 49 and line 50 at the E end. Similarly, the command signals are provided to directional valve 36 through lines 39, 40, shuttle valve 41, line 42, shuttle valve 51 and line 52 at the R end and line 39*a*, shuttle valve 46, line 47, shuttle valve 53 and line 54 at the E end. Likewise, the command signals are provided to directional valve 37 through line 39, shuttle 55 and line 56 at the R end and through line 39*a*, line 57, shuttle 58 and line 59 at the E end.

Figure 5:
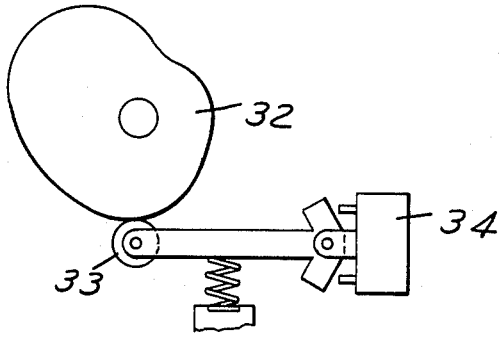
FIG. 5 is a fragmentary view of another portion of the system.

The pilot signals from the hydraulic remote control valves 34, shown in FIG. 5, of the position sensing devices 20, 24 are connected to provide an error signal to modify the pilot command signal from the command HRC valve 38. Thus, the valve 34 of position sensing device 20 is connected to modify the retract signals applied to the R end of directional valve 35 through line 60 through shuttle 49 and line 50 to the E end; and to modify the extend signal applied to the E end of directional valve 35 through lines 61, 62 to shuttle 44 and line 45 at the R end. The valve 34 of device 20 is similarly connected to modify the signal to the R and E ends of directional valve 36 through line 60, to shuttle valve 51 and line 61 to shuttle valve 53.

The valve 34 of position sensing device 24 is connected to modify the command signals to directional valve 35 through line 63, shuttle valve 46, line 47, line 48, shuttle valve 49 and line 50 at the E end and through line 64, shuttle valve 41, lines 42, 43, shuttle valve 44 and line 45 at the R end. Similarly, the device 24 modifies the command signal of directional valve 36 through line 63, shuttle valve 46, line 47, shuttle valve 53 and line 54 at the E end and through line 64, shuttle valve 41, line 42, shuttle valve 51 and line 52 at the R end. Likewise, device 24 modifies the signal to directional valve 37 through line 63, line 65, shuttle valve 55 and line 56 at the R end and line 64, line 66, shuttle valve 58 and line 59 at the E end.

Thus, each of the shuttle valves functions to compare the pilot signals thereto and select the larger for transmission to the respective directional valve.

What is claimed is:

1. A hydraulic system for synchronizing the movement of telescoping sections of a crane boom comprising a fixed section and first and second movable sections that can be extended and retracted, a first hydraulic actuator between said fixed section and said first movable section for extending and retracting said fixed section relative to said first movable section, a second hydraulic actuator between said first movable section and said second movable section for extending and retracting said second movable section relative to said first movable section, first and second pilot operated directional valves for controlling the flow rate of fluid to said first and second actuators, respectively, each said directional valve having openings to which pilot pressure is selectively applied to extend or retract its respective actuator, a command hydraulic remote control valve for applying pilot pressure to said first and second directional control valves simultaneously, cable means between said fixed section and said first and second movable sections positioned such that non-uniformity in movement between said sections causes a change in displacement of said cable means, a position signal sensing means associated with said cable means for producing a pilot pressure signal in response to variations in the tension on the cable means as a result of non-uniformity in movement of the respective sections, and means hydraulically connected to said command valve and said sensing means and responsive to the pilot pressure signal from the command valve and any signal from the sensing means for modifying the pilot pressure signal to the directional valves so that the flow of hydraulic fluid to the hydraulic actuators is modified to reduce the flow rate of fluid to the one actuator which is moving faster than the other in order to maintain synchronism between the movement of the first and second sections.

2. The hydraulic system set forth in claim 1 wherein said cable means comprises a first cable having one end fixed to said second movable section, a pulley fixed on said first movable section, said cable being trained over said pulley, a drum mounted on said fixed section for rotary movement in two directions, said cable having its other end wound around said drum, a hydraulic motor applying a continuous torque to said drum, a cam attached to said drum, said position signal sensing means comprising a remote control valve connected to said command control valve and said first and second directional valves and having a cam follower bearing on the cam such that pilot signals are produced by said remote control valve when the drum rotates in either direction.

3. The hydraulic system set forth in claim 2 wherein said means responsive to said pilot pressure signal from the command valve and any signal from said sensing means comprises shuttle valve means associated with each opening of each directional valve connected to the command control valve and remote control valve and operable to compare the pilot pressure signal from the command valve and the remote control valve of the sensing means and provide a modified signal to the respective opening of the directional valve to reduce the flow rate of fluid to the one actuator which is moving faster than the other.

4. The hydraulic system set forth in claim 1 including a third movable section that can be extended or retracted, a third hydraulic actuator between said second movable section and said third movable section for extending and retracting said third movable section relative to said second movable section, a third pilot operated directional valve for controlling the operation of said third actuator, said command hydraulic remote control valve applying pilot pressure to said third directional control valve simultaneously with said first and second directional valves, second cable means between said fixed section, second and third sections such that non-uniformity and movement between said fixed section, second and third sections causes a change in displacement of said second cable means, second position sensing means associated with said second cable means for producing a pilot pressure signal in response to variations in the tension of said second cable means as a result of non-uniformity in movement of the respective systems, said means responsive to the pilot pressure signal from the command valve and said first mentioned sensing means being hydraulically connected to said second sensing means such that said means is responsive to the pilot pressure signal from the first mentioned sensing means and any signal from the second sensing means to modify the flow to the first, second and third actuators to reduce the flow rate to the actuator which is moving faster than the others and to maintain synchronism between the first, second and third actuators.

5. The hydraulic system set forth in claim 4 wherein said means responsive to said pilot pressure signal from the command valve and any signal from said sensing means comprises shuttle valve means associated with each opening of each directional valve connected to the command control valve and remote control valve and operable to compare the pilot pressure signal from the command valve and the remote control valve of the sensing means and provide a modified signal to the respective opening of the directional valve.

6. A hydraulic system for synchronizing the movement of telescoping sections of a crane boom comprising a fixed section and first and second movable sections that can be extended and retracted, a first hydraulic actuator between said fixed section and said first movable section for extending and retracting said first movable section, a second hydraulic actuator between said first movable section and said second movable section for extending and retracting said second movable section relative to said first movable section, first and second pilot operated directional valves for controlling the operation of said first and second actuators, respectively, each said directional valve having openings to which pilot pressure is selectively applied to extend or retract its respective actuator, a command hydraulic remote control valve for applying pilot pressure to said first and second directional control valves simultaneously, cable means between said fixed section and said first and second movable sections positioned such that non-uniformity in movement between said sections causes a change in displacement of said cable means, a position signal means associated with said cable means for producing a pilot pressure signal in response to variations in the tension on the cable means as a result of non-uniformity in movement of the respective sections, and means responsive to the pilot pressure signal from the command valve and any signal from the sensing means for modifying the pilot pressure signal to the directional valves so that the flow of hydraulic fluid to the hydraulic actuators is modified to further extend or retract the sections in order to maintain synchronism between the movement of the first and second sections, a third movable section that can be extended or retracted, a third hydraulic actuator between said second movable section and said third movable section for extending and retracting said third movable section relative to said second movable section, a third pilot operated directional valve for controlling the operation of said third actuator, said command hydraulic remote control valve applying pilot pressure to said third directional control valve simultaneously with said first and second directional valves, second cable means between said fixed section, second and third sections such that non-uniformity and movement between said fixed section, second and third sections causes a change in displacement of said second cable means, said means responsive to the pilot pressure signal from the command valve and any signal from the second sensing means as well as the first sensing means to modify the flow to the first, second and third actuators to maintain synchronism between the first, second and third actuators, said second cable means comprising a second cable having one end fixed to said third section, a pulley on said second movable section, a free pulley, a third cable having one end fixed to said second movable section and trained over said free pulley, said second cable being trained over said pulley and having its other end connected to the aforementioned free pulley, a second drum mounted on said fixed section for rotation in two directions, said third cable having its other end wound around said second drum, a hydraulic motor applying a continuous torque to said second drum, a cam attached to said drum, said second position signal means comprising a second remote control valve connected to said command control valve and said first, second and third directional valves and having a cam follower bearing on the cam such that the pilot signals are produced by said second remote control valve when the second drum rotates in either direction.

* * * * *